United States Patent [19]

Mukai et al.

[11] 4,455,078

[45] Jun. 19, 1984

[54] CHARGING DEVICE HAVING A CONDUCTIVE PARTICLE IMPREGNATED STRAND LINED CONTACT MEMBER

[75] Inventors: Hideo Mukai, Yokohama; Toshimasa Takano, Sagamihara, both of Japan

[73] Assignee: Tokyo Shibaura Denki Kabushiki Kaisha, Kawasaki, Japan

[21] Appl. No.: 310,721

[22] Filed: Oct. 13, 1981

[30] Foreign Application Priority Data

Oct. 14, 1980 [JP] Japan ..... 55-143305

[51] Int. Cl.[3] ..... G03G 15/00

[52] U.S. Cl. ..... 355/3 CH; 361/221; 252/511

[58] Field of Search ..... 355/3 CH, 14 CH; 361/220, 221; 430/902; 252/502–504, 506–510, 511; 162/138

[56] References Cited

U.S. PATENT DOCUMENTS

| | | | |
|---|---|---|---|
| 2,774,921 | 12/1956 | Walkup | 355/3 CH |
| 3,671,806 | 6/1972 | Whitmore et al. | 355/3 CH |
| 3,691,993 | 9/1972 | Krause et al. | 355/3 TR |
| 3,900,591 | 8/1975 | Kline | 355/3 TR |
| 4,061,827 | 12/1977 | Gould | 252/511 X |
| 4,064,075 | 12/1977 | Hull | 252/511 |
| 4,336,565 | 6/1982 | Murray et al. | 355/3 CH |

*Primary Examiner*—R. L. Moses

*Attorney, Agent, or Firm*—Cushman, Darby & Cushman

[57] ABSTRACT

A charging device comprises a contact piled cloth which is formed of pliable material, has an electric resistance chosen to be $10^8$ Ω.cm and contacts with a photosensitive layer of a photosensitive drum, an electrode which is electrically connected to the contact piled cloth and has an electric resistance lower than the predetermined electric resistance of the contact piled cloth, and D.C. power source and A.C. power source for supplying a voltage on the electrode to charge the photosensitive layer. The contact piled cloth is provided with a multitude of raised furs formed of artificial fibers with conductive particles dispersed therein.

10 Claims, 25 Drawing Figures

CHARGING DEVICE HAVING A CONDUCTIVE PARTICLE IMPREGNATED STRAND LINED CONTACT MEMBER

BACKGROUND OF THE INVENTION

This invention relates to a charging device of a contact type, more specifically to a charging device having a flexible contact member to be in contact with an object to be charged.

Conventionally, most electrostatic copying apparatus use chargers including corona dischargers. These corona dischargers, however, are subject to several defects; hazards due to the use of high voltage, pollution of the atmosphere and equipment caused by ozone, and high manufacturing cost. As for the conventional charging methods using rollers or brushes, photosensitive materials would be damaged mechanically and electrically. Thus, none of these methods can be adapted to those photosensitive materials which are to be used thousands of times or more.

Recently, a charging device has been proposed which solves the aforesaid problems having a contact member which is formed of pliable material. The contact member has a predetermined electric resistance and contacts with an object to be charged. An electrode is electrically connected to the contact member and has an electric resistance lower than the predetermined electric resistance of the contact member. Means are provided for supplying voltage on the electrode to charge the object being charging. This is a contact-type charging device in which a DC voltage and an attenuating AC voltage are applied to the electrode which is disposed at the back of the contact member formed of a material such as a brush with a proper electric resistance. In charging operations repeated thousands of times or more, the use of such charging device should produce good results.

The resistance of the contact member varies with the changes of ambient conditions, especially humidity. Since the change of the resistance of the contact member has a bad influence upon the charging efficiency, it is necessary to keep the resistance of the contact member at a desired fixed value. In the proposed charging device, therefore, the change of the charging efficiency caused by the influence of humidity is prevented by continually heating the contact mamber by means of a heater to keep the contact member dry, or by providing a mechanism capable of charging the contact pressure of the contact member on a photosensitive layer as the object of charging according to humidity. With such arrangement, however, the charging mechanism is further complicated in construction, and it is necessary continually to supply power for heating and humidity sensing, resulting in an increase in running cost.

If the resistance of the contact member is reduced by humidity, furthermore, the amount of current flowing into the photosensitive material will increase possibly to shorten the life of the photosensitive material.

SUMMARY OF THE INVENTION

This invention is intended to provide a charging device of simple construction capable of preventing the pollution of equipment and air due to the production of ozone and greatly lengthen the life of an object to be charged as well as of preventing the charging efficiency from being reduced by the change of humidity without involving any increase in running cost.

According to an aspect of the present invention, there is provided a charging device which comprises a contact member which is formed of pliable material, has a predetermined electric resistance, and contacts an object being charging, an electrode which is electrically connected to the contact member and has an electric resistance lower than the predetermined electric resistance of the contact member, and means for supplying a voltage on the electrode to charge the object of charging, characterized in that the contact member is provided with a multitude of raised strands formed of artificial fibers with conductive particles dispersed therein.

DETAILED DESCRIPTION OF THE PREFERRED EMBODIMENTS

Figure 1:
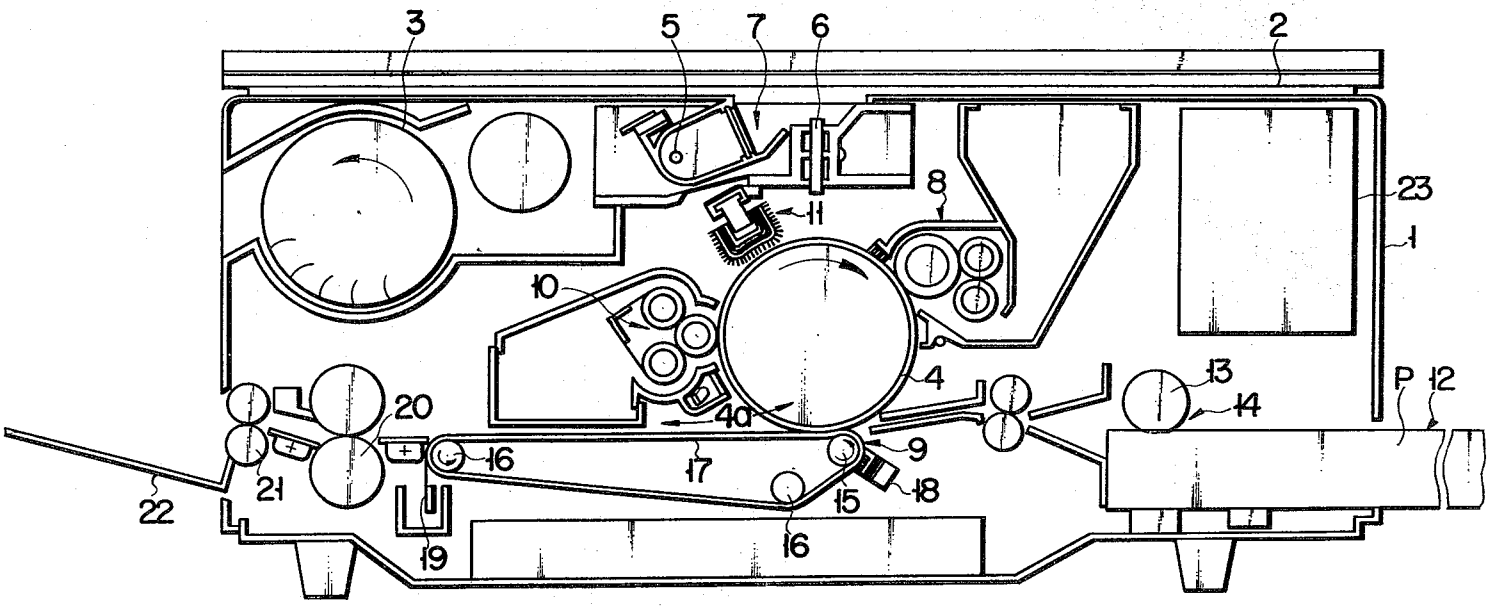
FIG. 1 is a side view schematically showing the internal structure of an electrostatic copying apparatus using a charging device according to this invention.
Figure 2:
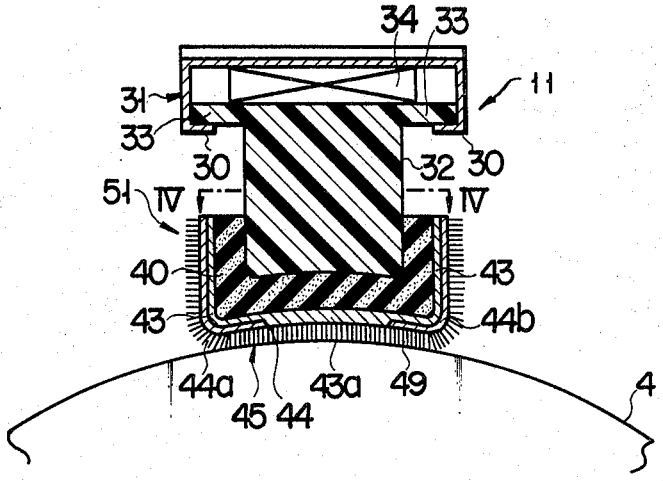
FIG. 2 is a profile of a charging device according to a first embodiment of the invention.

Referring now to the drawings of FIGS. 1 to 8, there will be described in detail a charging device according to a first embodiment of this invention.

FIG. 1 shows a fundamental arrangement of an electrostatic copying apparatus fitted with the charging device. A document carriage 2, which is mounted on the upper surface of a housing 1, is reciprocated by a driving motor 3 disposed inside the housing 1. Pivotally sustained in a substantially central portion of the housing 1 is a photosensitive drum 4*a* which rotates clockwise in synchronism with the reciprocation of the carriage 2. The photosensitive drum 4*a* includes a cylindrical base and a photosensitive layer 4 as an object of charging which is formed by dispersing resin in zinc oxide and laid on the outer circumferential surface of the cylindrical base. Disposed between the photosensitive layer 4 and the document carriage 2 is a light-irradiating system 7 which is composed of a lamp 5, a convergent light-transmitting element 6 and the like. The lamp 5 sheds a light on an original document put on the document carriage 2, and the convergent light-transmitting element 6 conducts a reflected light from the document onto the photosensitive layer 4 to form a latent image of the document on the photosensitive layer 4. A developing device 8, a transfer device 9, a cleaning device 10, and a charging device 11 as mentioned later are arranged around the photosensitive drum 4*a* in the order mentioned as counted from an image-forming position along the direction of the clockwise rotation of the photosensitive drum 4*a*. The developing device 8 actualizes by means of toner the latent image of the original document which is formed on the photosensitive layer 4 by the light-irradiating system 7 into a toner image. The transfer device 9 transfers the toner image of the document formed on the photosensitive layer 4 onto a sheet of copying paper P. The cleaning device 10 is intended to remove toner remaining on the surface of the photosensitive layer 4.

Disposed at one end of the bottom portion of the housing 12 is a paper feed device 14 which includes a detachable cassette 12 for storing a stack of copying paper P and a paper feed roller 13 for supplying sheets of paper P one by one between the photosensitive drum 4*a* and the transfer device 9. The transfer device 9 includes a driving roller 15, a plurality of driven rollers 16, and an electrically insulated, endless transfer belt 17 formed of e.g. polyethylene terephthalate film (manufactured by E. I. du Pont de Nemours & Co., of America with the trademark "Mylar") stretched between these rollers. The transfer belt 17 is in contact with part of the outer circumferential surface of the photosensitive drum 4*a*, and also with a charging device 18 for transfer of basically the same construction as the charging device 11 and a cleaning blade 19. Further, a fixing device 20 and a discharge roller 21 are disposed on the delivery end side of the transfer belt 17. A toner image is fixed by the fixing device 20 on the copying paper P onto which the image is transferred by the transfer device 9, and then the copying paper P is discharged by the discharge roller 21 into a tray 22 disposed at the other end portion of the housing 1. Numeral 23 designates a control device.

Hereupon, the motor 3 is a motor with an exhaust fan which rotates to discharge heat generated in the light-irradiating system 7 out of the housing 1. The photosensitive drum 4*a* is formed by coating a thin aluminum drum as the base having a thickness of 0.8 mm and a diameter of 80 mm or thereabouts with the photosensitive layer 4 which is obtained by dispersing resin into zinc oxide sensitized by a pigment such as Rose Bengal. Further, the cleaning blade 19 is intended to scrape the toner off the transfer belt 17 to clean the same.

Figure 3:
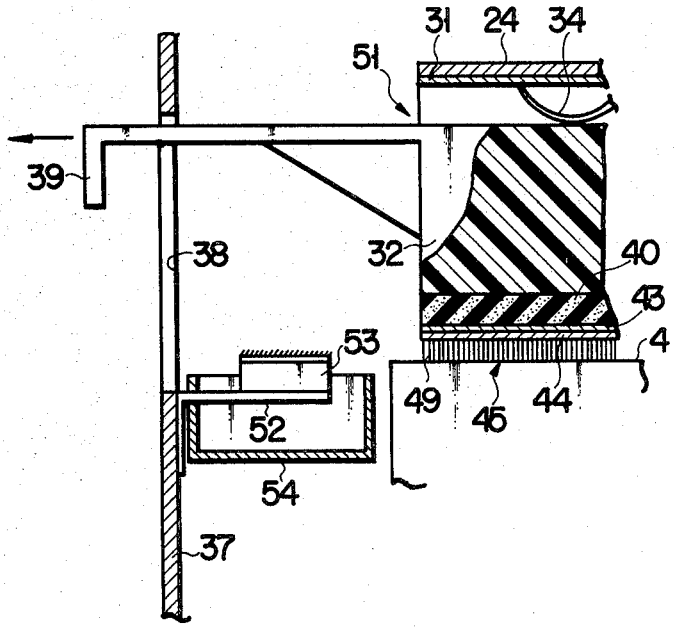
FIG. 3 is a cross-sectional view of the charging device shown in FIG. 2.
Figure 4:
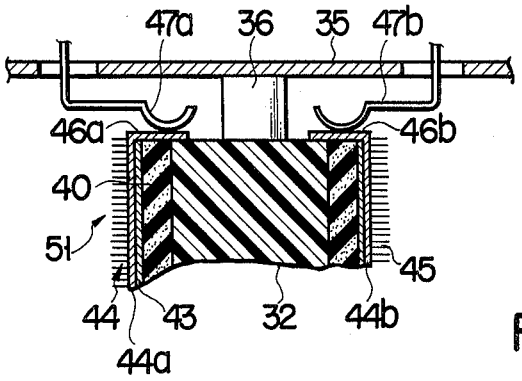
FIG. 4 is a sectional view of the charging device as taken along line IV—IV of FIG. 2.

Now the charging device 11 will be described in detail. FIGS. 2 to 8 show a first embodiment of the charging device 11 of this invention which is provided with a charger body 51. Facing the photosensitive layer 4, the charger body 51 includes a guide frame 31 which, having L-shaped bent portions 30 facing each other on both side edges thereof, is fixed to the frame of the housing 1. The guide frame 31 is detachably fitted with a charger base 32. The charger base 32 is formed in the shape of an angular pillar extending in a direction perpendicular to the drawing and prepared from resin material such as acrylic resin or ABS (acrylonitrile-butadiene-styrene). A pair of abutment collars 33 slidably engaging the bent portions 30 of the guide frame 31 integrally protrude from the top side of the charger base 32. A pressing spring 34 formed of a leaf spring is disposed between the top side of the charger base 32 and the under side of the guide frame 31. The spring 34 urges the abutment collars 33 to be in elastic contact with the bent portions 30, thereby pressing and holding the charger base 32 against the guide frame 31. As shown in FIG. 4, one end portion of the charger base 32 as viewed along the longitudinal direction thereof abuts against a stopper 36 protruding from a rear frame 35 which is disposed on the back side of the housing 1. As shown in FIG. 3, the other end portion of the charger base 32 faces a setting opening 38 which is defined in a front frame on the front side of the housing 1. A pull 39 protrudes from the end face of the charger base 32 opposite to the setting opening 38.

At the bottom portion of the charger base 32 which faces the outer circumferential surface of the photosensitive layer 4, there are a cushion member 40, an electrode 43, electric conductor 44, and a piled cloth 45 as a contact member, laminated in the order mentioned as counted from the bottom face of the charger base 32 toward the surface of the photosensitive layer 4. These layers are bonded together so as to embrace the bottom face and both lateral side faces of the charger base 32. The cushion member 40 is formed of a foamed plastic sheet of approximately 3 mm thickness to double as an insulating member. As for the electrode 43, it is composed of conductive rubber which is formed into a sheet of approximately 50 μm thickness in the following manner. First, a primary solution is prepared by blending at a ratio of 82.5:17.5 a solvent with a solid body obtained by mixing together 30 weight % of carbon (VULCAN XC-72, CABOT Co.), 50 weight % of SBR (TUFPRENE, ASAHI KASEI KOGYO K.K.), and 20 weight % of xylene resin (NIKANOL, MITSUBISHI GAS KAGAKU K.K.). Then, the primary solution is blended at a ratio of 1:1 with a secondary solution which is prepared by mixing 50% of SBR and 50% of solvent such as toluene. The electrode 43 has a specific resistance ($10^2$ to $10^4$ Ω.cm) lower than that of the cloth 45. The conductor 44, which is formed of an aluminum sheet with a thickness of approximately 50 μm, is divided crosswise into two parts; DC and AC conductive plates 44*a* and 44*b*. The DC and AC conductive plates 44*a* and 44*b* are partitioned off by a projected charging portion 43*a* formed at the central portion of the electrode 43. As shown in FIG. 4, the end portions of the DC and AC conductive plates 44*a* and 44*b* on the side of the rear frame 35 are bent along the end face of the charger base 32. These bent portions serve as respective contact terminals 46*a* and 46*b* of the conductive plates 44*a* and 44*b*. The rear frame 35 facing the contact terminals 46*a* and 46*b* is fitted with a DC-side power supply blade 47*a* and an AC-side power supply blade 47*b* which are in contact with the contact terminals 46*a* and 46*b*, respectively. Velveteen is used for the cloth 45.

Figure 5:
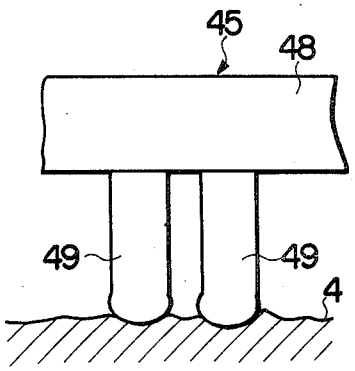
FIG. 5 is an enlarged front view of a contact member or cloth used in the charging device of FIG. 2.

As shown in FIG. 5, the velveteen cloth is composed of a cotton base 48 and a plurality of strands 49 with uniform electric resistance implanted in the base 48. The strands 49 are formed of artificial fibers which include carbon dispersed therein as conductive particles. Available for these artificial fibers are carbon-dispersed acrylic fibers (SA-7, TORAY), carbon-dispersed nylon fibers (BELLTRON, KENEBO LTD.), and carbon-dispersed rayon fibers (MEGA, UNITIKA). These artificial fibers form the velveteen cloth 45 as shown in Table 1.

Figure 6:
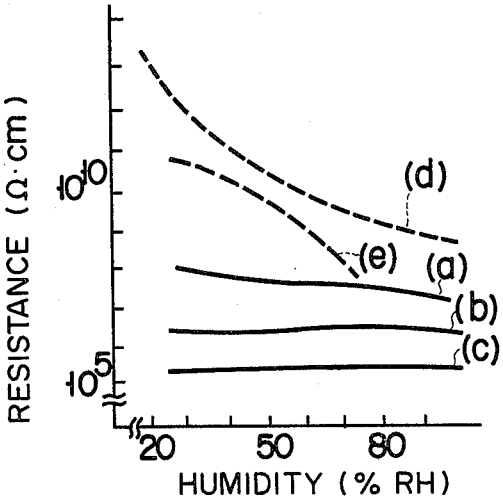
FIG. 6 is a diagram showing the relationship between the humidity and resistance of the contact member or cloth of FIG. 5.

FIG. 6 shows the relationships between the humidity and resistance of the cloth 45 with such strands 49. In FIG. 6, solid lines (a), (b) and (c) represent variations of the relationships in the cloth 45 with the strands 49 formed of carbon-dispersed acrylic fibers, carbon-dispersed nylon fibers, and carbon-dispersed rayon fibers, respectively. Further, broken lines (d) and (e) represent variations in cloths with strands formed of conventional rayon and acrylic fibers, respectively. As is evident from FIG. 6, the cloth 45 with the strands 49 formed of artificial fibers having carbon dispersed therein has uniform resistance ($10^5$ to $10^8$ Ω.cm) independent of the change of humidity. This may be attributed to the fact that the internal resistance of the strands 49 can be set lower than the surface resistance thereof by dispersing carbon in the artificial fibers, so that the electric resistance of the strands 49 as a whole may be kept constant without regard to the change of humidity because the internal resistance of the strands 49, which defines the general electric resistance of the strands 49, will not be influenced by humidity even though the surface resistance is changed by humidity.

TABLE 1

| Fibers (trademarks) | Fiber Thickness (d) | Length (mm) | Density (/cm$^2$) |
|---|---|---|---|
| SA-7 | 6.3 | 3.0 | 16,070 |
| BELLTRON | 6.7 | 2.5 | 20,088 |
| MEGA | 6.0 | 3.0 | 16,070 |

As shown in FIG. 5, the tip ends of the strands 49 are rounded so that the contact area between such tip ends and the surface of the photosensitive layer 4 may be wide enough. In the cloth 45 formed in this manner, the top surface of the base 48 is bonded to the conductor 44 by means of a conductive adhesive agent 50.

A cleaning brush 53 (trademark: Etiquette Brush) is attached to the vicinity of the setting opening 38 of the charger body 51 of the aforementioned construction by means of a support plate 52 fixed to the inner face of the front frame 37. A toner receptacle 54 is disposed under the cleaning brush 53 so that toner attached to the strands 45 may be scraped off by the cleaning brush 53 when the charger body 51 is pulled forward.

Figure 7:
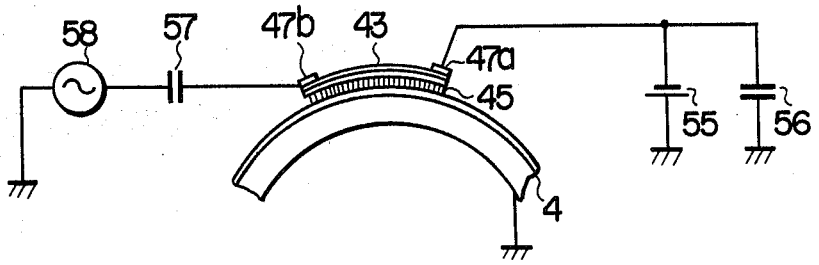
FIG. 7 is a connection diagram schematically showing the electric connection of the charging device.

As shown in FIG. 7, the DC-side power supply blade 47*a* is connected with the negative terminal of a DC power source 55 whose positive terminal is grounded. Also, the DC-side power supply blade 47*a* is connected with one end of a first capacitor 56 for bypassing AC current. The other end of the first capacitor 56 is grounded. On the other hand, the AC-side power supply blade 47*a* is connected with one end of an AC power source 58 through a second capacitor 57 for arresting the flow of DC current. The other end of the AC power source 58 is gounded. The aluminum drum supporting the photosensitive layer 4 is also grounded. In this embodiment, the DC and AC power sources 55 and 58 are rated for 2 kV, and the first and second capacitors 56 and 57 are rated for 0.03 μF, severally.

Figure 8:
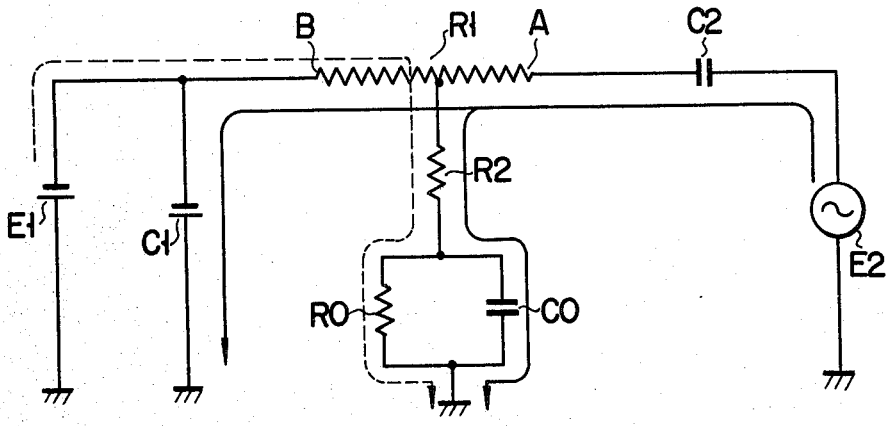
FIG. 8 is a circuit diagram equivalent to the connection diagram of FIG. 7.

FIG. 8 shows an equivalent circuit of the aforementioned arrangement. Symbols R1 and R2 indicate resistors represented as the equivalents of the electrode 43 and the cloth 45, respectively. Symbols E1 and E2 indicate the DC and AC power sources 55 and 58 applying DC and AC electric fields, respectively. Symbols C1 and C2 indicate the first and second capacitors 56 and 57, respectively. A parallel circuit of a resistor R0 and a capacitor C0 is an equivalent circuit of the photosensitive layer 4.

When the DC and AC electric fields are applied to both end sides of the electrode 43 by the power sources E1 and E2, respectively, currents flow as indicated by arrows in FIG. 8. The flows of the AC and DC currents are represented by solid and broken lines, respectively. Since the electrode 43 is equivalent to the resistor R1, the potential gradient provided by the AC electric field is such that the potential high at a point A in contact with the AC-side power supply blade 47*b* gradually decreases toward a point B in contact with the DC-side power supply blade 47*a*. On the other hand, the potential gradient provided by the DC electric field is such that the potential high at the point B gradually decreases toward the point A. Such impression of the electric fields makes at least the potential at one end portion of the electrode 43 compared with the ground point lower than the potential at any other portion of the electrode 43 compared with the ground point. Therefore, the photosensitive layer 4 will never be suddenly subjected to a high electric field to be damaged.

When the electric field is thus applied to the electrode 43, the capacitor C0 equivalently included in the photosensitive layer 4 is charged. As a result, the photosensitive layer 4 is charged with electricity.

In copying the original document on the document carriage 2, a copying start button (not shown) is pressed. Then, the several devices perform their respective conventional operations, and copying paper P bearing a document image is discharged into the tray 22. In the charging device 11, at this time, voltages from the power source devices 55, 58 are applied to the electrode 43, accompanying the rotation of the photosensitive layer 4. Since the electrode 43 is in contact with the DC and AC conductive plates 44a and 44b, the overall voltage applied to the electrode 43 is defined as a result of superposition of AC voltage on DC voltage. In this case, if an AC voltage of 2,000 V is superposed on a DC voltage of 2,000 V, the photosensitive layer 4 is protected from space charge and can fully be charged in a short time.

An experiment revealed that, in charging the photosensitive layer 4 of ZnO, the charging stability is poor and dark attenuation will be increased if only DC voltage is applied.

The reason is as follows. While the photosensitive layer 4 equivalently has capacitance Co, the particles of ZnO also equivalently have capacitance Cp from a microscopic point of view. In charging the photosensitive layer 4, each capacitance Cp is first charged up, which is deemed equivalent to charging of the capacitance Co on the whole. Hereupon, the AC filed is quite efficient when the capacitance Cp is charged up.

According to the first embodiment of this invention, as described in detail above, the strands 49 of the contact member are formed out of carbon-dispersed synthetic fibers, and have fixed resistance independent of humidity. Accordingly, the charging device 11 can regularly charge the photosensitive layer 4 without regard to the change of humidity.

In the aforementioned first embodiment, the strands 49 have been explained as being formed of synthetic fibers with carbon as conductive particles dispersed therein. Alternatively, however, the synthetic fibers as the core material may be coated with a high molecular substance in which conductive particles are dispersed. Thus, there is provided as a second embodiment a contact member which is manufactured in the following manner. In the description of various embodiments to follow, like or similar reference numerals are used to designate like or similar portions.

Figure 9:
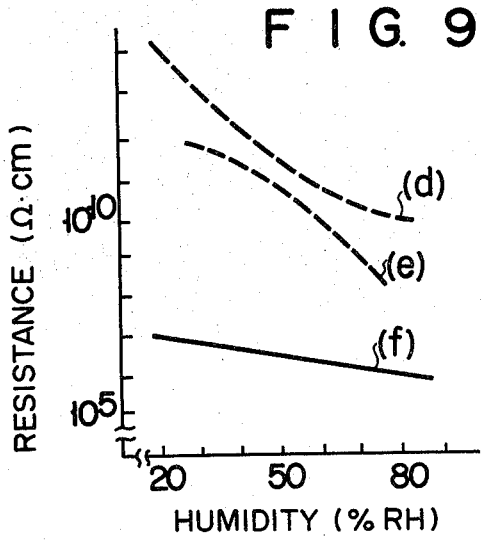
FIG. 9 is a diagram showing the relationship between the humidity and resistance of the contact member or cloth for illustrating a charging device according to a second embodiment of the invention.
Figure 10:
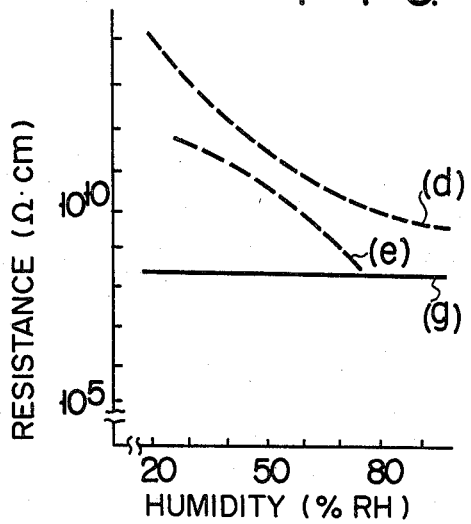
FIG. 10 is a diagram showing the relationship between the humidity and resistance of the contact member or cloth for illustrating a charging device according to a third embodiment of the invention.

Rayon velveteen with strands of 5 denier diameter, 3 mm length, and approximately 16,000/cm$^2$ density is immersed in a solvent consisting of 8 g of thermoplastic polyester (VYLON 300, TOYOBO K.K.), 2 g of carbon (VULCAN XC-72, CABOT CO.), 95 g of MEK, and 95 g of toluene for a minute, then air-dried at normal temperature, and finally napped by means of a 10 denier polyethylene strand brush. Strands on the contact member manufactured in this manner are each formed by coating a rayon core with carbon-dispersed thermoplastic polyester. An indicated by solid line (f) in FIG. 9, the contact member has a substantially fixed resistance independent of the change of humidity. By the use of the contact member with such strands, therefore, the charging device can maintain its charging state stable to the change of humidity. As a third embodiment, moreover, the contact member may be formed out of synthetic fibers carbonized under low air pressure. Namely, this contact member is formed by heating rayon velveteen of 5 denier diameter, 3 mm length and approximately 16,000/cm$^2$ density to a temperature of 500° C. under a pressure of $1.0\times10^{-2}$ Torr and carbonizing it for 35 minutes. The contact member thus formed has a substantially fixed resistance independent of the change of humidity, as indicated by solid line (g) in FIG. 10. By the use of such contact member, therefore, the charging device can maintain its charging state stable to the change of humidity.

Figure 11:
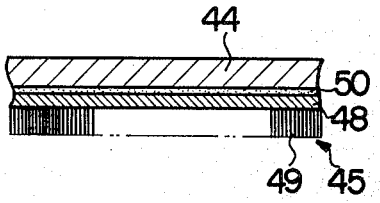
FIG. 11 is a sectional view of a charging device according to a fourth embodiment of the invention.

In the aforementioned first embodiment, the cloth 45 as a contact member and the electrode 43 are provided separately and coupled by means of the conductive adhesive agent 50. As a fourth embodiment, however, the base 48 of the cloth 45 may be formed out of fibers with an electric resistance lower than that of the strands 49 and bonded directly to the conductor 44 by means of the conductive adhesive agent 50, as shown in FIG. 11. For example, the cloth 45 may be composed of strands 49 made of carbon-dispersed nylon fibers from KANEBO K.K. and a base 48 made of carbon-dispersed rayon fibers from UNITIKA. Since the strands 49 and the base 48 thus constructed have resistances of $10^6$ to $10^7$ Ω.cm and $10^5$ to $10^6$ Ω.cm, respectively, the base 48 can serve as an electrode.

In this arrangement of the fourth embodiment, it is unnecessary separately to provide the electrode, so that the manufacture is simplified to bring about a reduction in cost. Doing without a metal electrode, the charging device can be made flexible as a whole and can enjoy soft contact with the photosensitive layer 4. Accordingly, the possibility of the photosensitive layer 4 suffering mechanical damage can be reduced to lengthen the life of the photosensitive layer 4.

Figure 12:
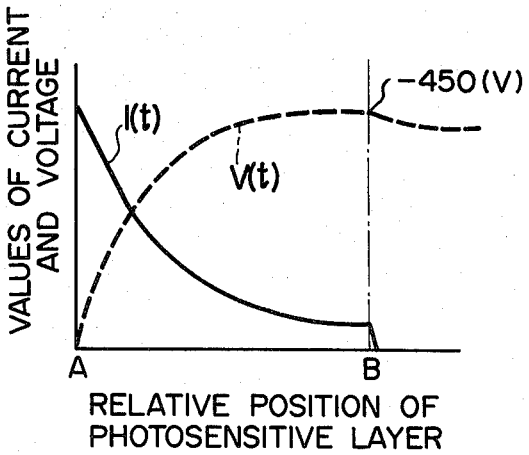
FIG. 12 is a diagram showing the relationships between the values of current and voltage and the position of a photosensitive layer used in the first embodiment.
Figure 13:
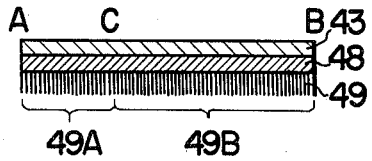
FIG. 13 is a sectional view of a contact member or cloth used in a charging device according to a fifth embodiment of the invention.
Figure 14:
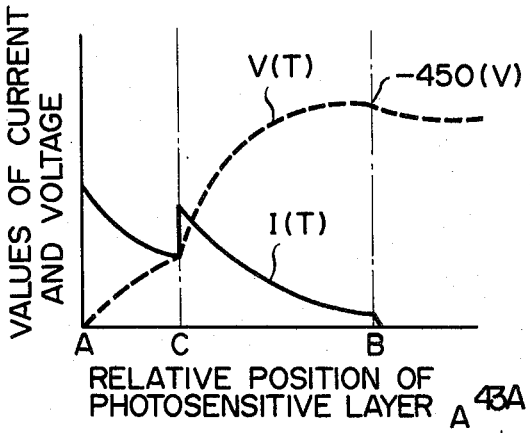
FIG. 14 is a diagram showing the relationships between the values of current and voltage and the position of the photosensitive layer obtained with use of the contact member or cloth of FIG. 13.

Referring now to FIGS. 12 to 14, there will be described a fifth embodiment of the invention.

FIG. 12 shows how a specific infinitesimal portion of the photosensitive layer 4 in the first embodiment is charged to obtain the surface potential. If the photosensitive layer 4 is regarded as a capacitor, the current I(t) flowing into the photosensitive layer is $$I(t)=(V-V(t))/R,$$

and the surface potential V(t) on the photosensitive layer is $$V(t)=\frac{1}{C}\int_{o}^{t} I(t)dt.$$

Here V is the AC power supply voltage, R is the resistance of the contact member, and C is the capacitance of the photosensitive layer. If there is given another condition that the surface potential obtained when the contact member initially touches the photosensitive layer 4 is 0 V, we obtain $$I(t)=\frac{V}{R}\exp\left(-\frac{t}{RC}\right) \text{ (represented by solid line in FIG. 12),}$$

$$V(t)=V\left\{1-\exp\left(-\frac{t}{RC}\right)\right\} \text{ (represented by broken line.)}$$

From these two equations and the drawing of FIG. 12, it may be understood that the current flowing into the photosensitive layer 4 takes its maximum when the contact member initially comes in contact with the photosensitive layer 4. At this time, therefore, electrical damage to the photosensitive layer 4 is maximized to shorten the life of the photosensitive layer 4.

In the fifth embodiment, unlike in the first embodiment in which the electric resistance of the strands 49 is uniform, the resistance of the strands 49 is changed at a point C to eliminate the aforesaid drawback, as shown in FIG. 13. Namely, in FIG. 13, symbols A and B indicate the positions of the first and last strands 49 the photosensitive layer 4 touched, respectively. A first strand section 49A including the fur indicated by symbol A is higher in resistance than a second strand section 49B including the fur indicated by symbol B. Thus, an infinitesimal portion of the photosensitive layer 4 is charged according to the change of the resistance of the strands 49 as shown in FIG. 14. At the first strand section 49A, a current represented by a solid line in FIG. 14 is limited due to the high resistance. At the second strand section 49B, on the other hand, the peak current at the point C is relatively low because the photosensitive layer 4 has a potential represented by a broken line in FIG. 14 although the resistance is set at the same level as in the first embodiment. Thus, the photosensitive layer 4 is protected against electrical damage, and can enjoy prolonged life. In the fifth embodiment, the photosensitive layer 4 is formed of zinc oxide, the circumferential speed of the photosensitive drum 4*a* is 80 mm/sec, the strands 49 are formed of carbon-dispersed rayon fibers, and the difference between the resistances at the first and second strand sections 49A and 49B is controlled by the amount of dispersed carbon. Further, the length, thickness and density of the strands 49 are 3 mm, 5 denier and approximately 16,000/cm$^2$, respectively, and the widths of the first and second strand sections 49A and 49B are 10 mm and 15 mm, respectively.

When the fifth embodiment was actually executed in these conditions, a charging state similar to the one obtained in the first embodiment was obtained, and the life of the photosensitive layer 4 was lengthened. In this fifth embodiment, moreover, the resistance of the strands 49 has been explained as changing in two stages with the point C as a junction. Alternatively, however, the amount of dispersed carbon may be controlled so that the resistance may be reduced linearly from the point A to the point B, or changed in a multitude of different stages. With such arrangement, the photosensitive layer 4 can further be protected against electrical damage.

Figure 15:
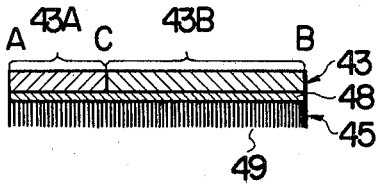
FIG. 15 is a sectional view of an electrode used in a charging device according to a sixth embodiment of the invention.

In the aforementioned fifth embodiment, moreover, the resistance of the strands 49 is changed in order to protect the photosensitive layer 14 against electrical damage. As a sixth embodiment, the electrical damage may be prevented by changing the resistance of the electrode 43, as shown in FIGS. 15 to 17.

Namely, the resistance of a first electrode section 43A extending from a portion indicated by symbol A to a position indicated by symbol C is set higher than that of a second electrode section 43B extending from the position C to a portion indicated by symbol B. For example, the resistances of the first and second electrode sections 43A and 43B are set at $10^7$ Ω.cm and $10^6$ Ω.cm, respectively. These electrode sections are formed of SBR, carbon and xylene resin, and have a thickness of 5 mm. The resistances of the electrode sections are changed according to the carbon content. As for the strands 49, they are formed of carbon-dispersed rayon fibers, having $10^7$ Ω.cm resistance, 5 denier thickness, 3 mm length, and approximately 16,000/cm$^2$ density.

Figure 16:
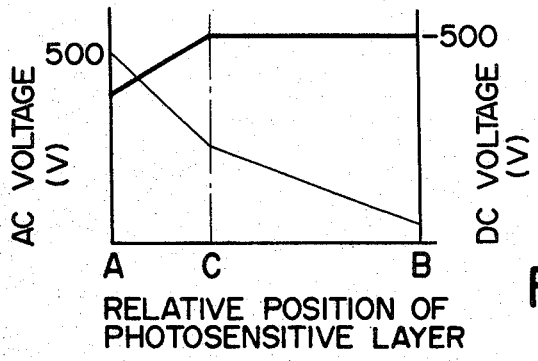
FIG. 16 is a diagram showing the relationships between the AC and DC voltages applied to the contact member or cloth and the intra-electrode position obtained with use of the electrode of FIG. 15.
Figure 17:
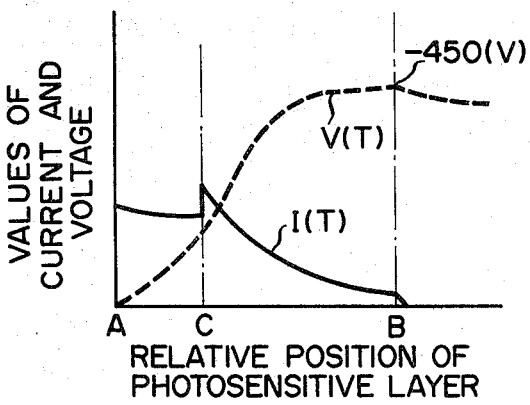
FIG. 17 is a diagram showing the relationships between the values of current and voltage and the position of the photosensitive layer obtained with use of the electrode of FIG. 15.

With such arrangement, the voltage applied to the contact member or cloth 45 is as shown in FIG. 16. As indicated by a thick line in FIG. 16, the DC voltage applied from a side indicated by symbol B, and the resistance of the second electrode section 43A is lower than that of the strands 49, so that the potential at the second electrode section 43B is substantially constant. At the first electrode section 43A, the resistance is substantially equal to that of the strands 49, so that a voltage drop appears, and the potential decreases from the position indicated by symbol C toward the portion indicated by symbol A. Accordingly, the peak value of the current at the portion indicated by symbol A, as indicated by a solid line in FIG. 17, becomes smaller due to the low potential at that portion, thereby reducing the electrical damage to the photosensitive layer 4. As indicated by a thin line in FIG. 16, moreover, the AC voltage is applied from a side indicated by symbol A, and the voltage drop at the first electrode section 43A becomes greater, so that the influence of the AC voltage upon the charging at the portion indicated by symbol B can be reduced to widen the proper range of AC voltage. It is to be understood that the resistance of the electrode 43 need not change in two stages with the position C as the junction, just as in the case of the fifth embodiment. For example, the resistance may increase linearly or in a multitude of different stages.

Figure 18:
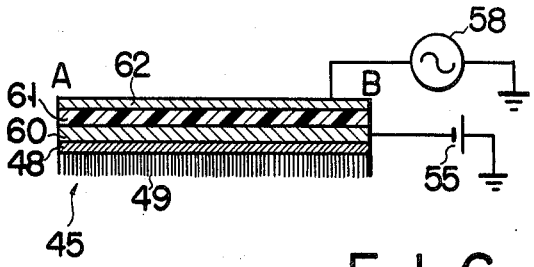
FIG. 18 is a sectional view of an electrode used in a charging device according to a seventh embodiment of the invention.
Figure 19:
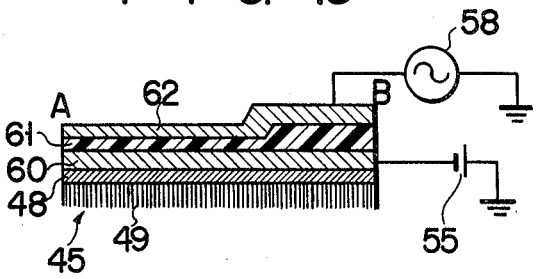
FIG. 19 is a sectional view showing a modification of the seventh embodiment shown in FIG. 18
Figure 20:
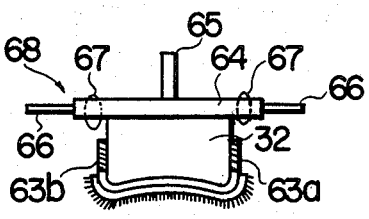
FIGS. 20 and 21 are front and side views of a charger base used in a charging device according to an eighth embodiment of the invention, respectively.
Figure 21:
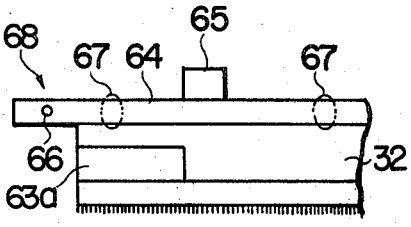
Figure 22:
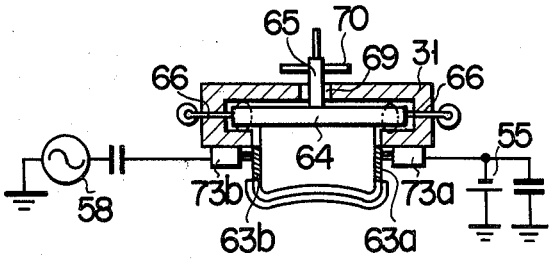
FIGS. 22 and 23 are front and plan views of the charging device using the charger base of FIGS. 20 and 21, respectively.
Figure 23:
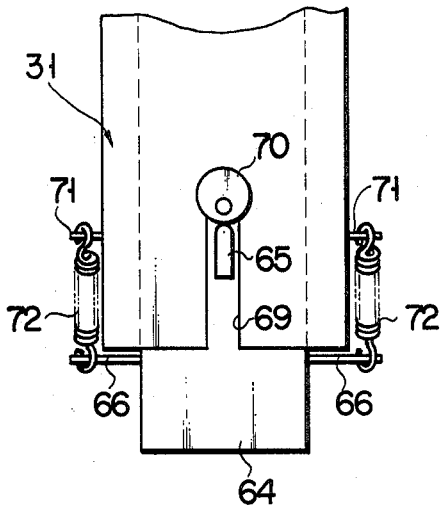

Referring now to FIGS. 18 and 19, there will be described a seventh embodiment of the invention.

In the first embodiment, the circuit shown in FIG. 7 is effectively used for stably obtaining the charging potential at the photosensitive layer 4 formed of zinc oxide, expecially. However, if the AC voltage at the portion indicated by symbol B is too high, charging will be subject to unevenness. Therefore, it is necessary to reduce the AC voltage gradually from the portion indicated by symbol A toward the portion indicated by symbol B. Then, in the first embodiment, the AC voltage is reduced by means of the first capacitor 56. Accordingly, AC current continually flows through the electrode 43, resulting in waste of power. Moreover, the rate of reduction of voltage may possibly be influenced directly by the resistance of the electrode 43.

The aforesaid awkwardness may be eliminated with use of the arrangement of FIG. 18 as the seventh embodiment. Namely, a first electrode 60 is bonded to the top surface of the base 48 of the contact member 45 by means of a conductive adhesive agent. A dielectric layer 61 is bonded to the top surface of the first electrode 60, while a second electrode 62 is bonded to the top surface of the dielectric layer 61. Then, the DC and AC power sources 55 and 58 are connected with the first and second electrodes 60 and 62, respectively. In this embodiment, the contact member 45 is a velveteen cloth which is formed of carbon-dispersed rayon fibers and has strands 49 with 5 denier thickness, 3 mm length, and approximately 16,000/cm$^2$ density, exhibiting a resistance of $10^7$ Ω.cm. The first electrode 60 is formed of carbon, SBR, and xylene resin, and has a resistance of $10^6$ Ω.cm. The dielectric layer 61 is formed of a polyester film (trademark: Mylar), and has a thickness of 12 μm. The second electrode 62 is formed of the same materials as the first electrode 60, and has a resistance of $10^2$ Ω.cm. A DC voltage of −800 V is applied from the DC power source 55, and an AC voltage of −80 V, 50 Hz is applied from the AC power source 58 so that the photosensitive drum may have a circumferential speed of 80 mm/sec. With such arrangement, the photosensitive layer 4 is charged to a stable surface potential of −400 to −450 V. In this embodiment, the suitable AC voltage applied is 10 to 20% of the DC voltage applied. Lower AC voltage will cause "ill-spread" potential, while higher AC voltage will cause unevenness in charging.

The unevenness in charging is caused by the passage of a large AC current through a point B as the charging end point. By thickening the dielectric layer 61 in the vicinity of the point B, as shown in FIG. 19, the flow of AC current can be controlled. As a result, the proper range of AC voltage can be widened, and further stable charging state can be obtained by increasing the AC voltage.

Referring now to FIGS. 20 to 23, there will be described an eighth embodiment of the invention.

In the first embodiment, although the charger body 51 can be removed from the guide frame 31, it is held in place by the guide frame 31 during the charging operation. Alternatively, however, a charger body 68 may be so designed as to oscillate along the axial direction of the photosensitive drum 4*a*. In this case, sliding terminals 63*a* and 63*b* connected with the contact terminals 46*a* and 46*b* are disposed on both lateral sides of the charger base 32 of the charger body 68, respectively. A support plate 64 is laid on the top of the charger base 32. An axially extending abutment plate 65 protrudes upward from a predetermined position on the top surface of the support plate 64. Further, a first pin 66 horizontally extends from predetermined portions of both side end faces of the support plate 64. Pivotally mounted in predetermined positions on the top surface of the support plate 64 are a plurality of rollers 67 for facilitating the charger body 68 to be inserted in the guide frame 31 for oscillation.

The guide frame 31 in which such charger body 68 is inserted has a slit 65 formed in the top surface thereof to allow penetration of the abutment plate 65. A cam plate 70 on which the abutment plate 65 abuts is rockably mounted on the end portion of the slit 69. The cam plate 70, which is discoid in shape, is mounted eccentrically so as to be driven by a driving mechanism (not shown) to rotate in accordance with the rotation of the photosensitive drum 4*a*. On both lateral side end portions of the guide frame 31, moreover, a second pin 71 horizontally faces the first pin 66 so that tension springs 72 are stretched between the first and second pins 66 and 71. These springs 71 urges the charger body 68 so that the abutment plate 65 on the charger body 68 may always abut on the cam plate 70. Disposed on the under side of the guide frame 31 are electric brushes 73*a* and 73*b* in contact with the sliding terminals 63*a* and 63*b* to supply power thereto. The DC and AC power sources 55 and 58 are connected with the electric brushes 73*a* and 73*b*, respectively.

With the aforementioned arrangement, the cam plate 70 rotates in accordance with the rotation of the photosensitive drum 4*a*, so that the charger body 68 having the abutment plate 65 abutting on the cam plate 70 may oscillate along the axial direction.

Such oscillation prohibits the probability of contact between the photosensitive layer 4 and the strands 49 from being reduced to cause stripes of low-surface-potential region on the photosensitive layer 4 due to the existence of fallen ones among the strands 49 to be in contact with the photosensitive layer 4.

It is experimentally confirmed that greater amplitude and higher oscillation frequency produce a greater effect. In this embodiment, the amplitude is set greater than the length of the strands 49, and the relative axial velocity of the photosensitive drum 4*a* and the charging device provided by the oscillation is higher than the relative circumferential velocity of the photosensitive drum 4*a* and the charging device provided by the rotation of the photosensitive drum 4*a*.

Figure 24:
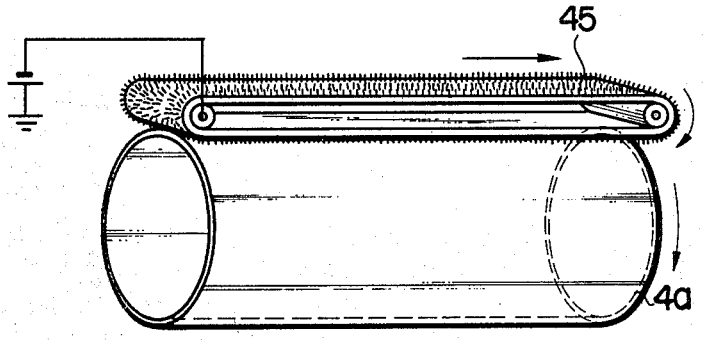
FIG. 24 is a perspective view of a charging device according to a ninth embodiment of the invention.

The production of the stripes of low-potential region on the photosensitive layer 4 attributable to the existence of the fallen strands 49 may be prevented by the arrangement of FIG. 24 as a ninth embodiment. In this arrangement, the cloth 45 as the contact member is formed endless, and is brought in axial slide contact with the outer circumferential surface of the photosensitive drum 4*a*. Thus, the same effect as in the eighth embodiment may be obtained.

Figure 25:
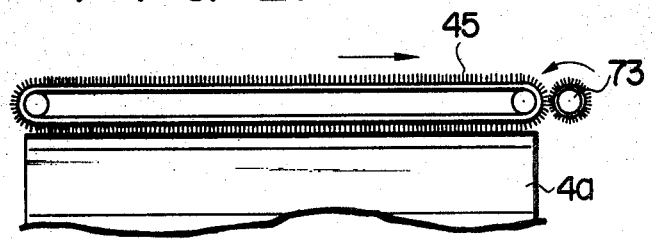
FIG. 25 is a side view of a charging device according to a tenth embodiment of the invention.

FIG. 25 shows a tenth embodiment of this invention. In this arrangement, a fur brush 73 for napping the strands 49 of the endlessly formed cloth 45 is rotatably disposed in contact with the outer peripheral surface of the cloth 45. Thus, the same effect of the ninth embodiment may be obtained. The fur brush 73 has furs formed of polypropylene of 5 denier thickness and 6 mm length.

What we claim is:

1. A charging device comprising:

a contact member formed of pliable material and having a predetermined electric resistance for contacting an object to be charged, said contact member having a multitude of raised strands formed of artificial fibers with conductive particles dispersed therein, the electric resistance of said multitude of strands gradually becoming lower along said contact member by stages in a direction of movement of said object to be charged;

an electrode electrically connected to said contact member and having an electric resistance lower than said predetermined electric resistance of said contact member; and means for supplying a voltage on said electrode to charge said object to be charged.

2. The charging device according to claim 1, wherein said electrode has substantially uniform electric resistance.

3. A charging device for charging an object moving in one direction comprising:

a contact member formed of pliable material and having a predetermined electric resistance for contacting said object, said contact member having a multitude of raised strands formed of artificial fibers with conductive particles dispersed therein;

an electrode electrically connected to said contact member and having an electrical resistance lower than said predetermined electric resistance of said contact member, the electric resistance of said electrode gradually becoming lower along the moving direction of said object; and means for supplying a voltage on said electrode to charge said object.

4. The charging device according to claim 2 or 3, wherein said conductive particles include carbon.

5. The charging device according to claim 4, which further comprises a base member for supporting said multitude of strands.

6. The charging device according to claim 5, wherein said base member is formed of cotton cloth.

7. The charging device according to claim 6, wherein said base member and said electrode are bonded together by means of an adhesive agent.

8. The charging device according to claim 5, wherein said base member is formed of artificial fibers with conductive particles dispersed therein.

9. The charging device according to claim 8, wherein the electric resistance of said base member is lower than that of said strands.

10. The charging device according to claim 1 or 3, wherein said multitude of strands have substantially uniform electric resistance.

* * * * *